US008692528B2

(12) United States Patent
Wang et al.

(10) Patent No.: US 8,692,528 B2
(45) Date of Patent: Apr. 8, 2014

(54) LOW DROPOUT REGULATOR

(75) Inventors: Chua-Chin Wang, Taipei County (TW); Shao-Fu Yen, Taipei County (TW)

(73) Assignee: Acer Incorporated, Taipei County (TW)

( * ) Notice: Subject to any disclaimer, the term of this patent is extended or adjusted under 35 U.S.C. 154(b) by 293 days.

(21) Appl. No.: 12/685,962

(22) Filed: Jan. 12, 2010

(65) Prior Publication Data

US 2011/0062922 A1 Mar. 17, 2011

(30) Foreign Application Priority Data

Sep. 15, 2009 (TW) ..... 98131132 A

(51) Int. Cl.
*G05F 1/00* (2006.01)

(52) U.S. Cl.
USPC ..... 323/271; 323/273; 323/274; 323/280

(58) Field of Classification Search
USPC ..... 323/271, 281, 282, 284, 285, 286, 313, 323/314, 317
See application file for complete search history.

(56) References Cited

U.S. PATENT DOCUMENTS

| | | | | |
|---|---|---|---|---|
| 5,811,861 | A * | 9/1998 | Nunokawa | 257/379 |
| 6,084,391 | A * | 7/2000 | Onodera | 323/315 |
| 6,118,266 | A * | 9/2000 | Manohar et al. | 323/316 |
| 6,643,151 | B1 * | 11/2003 | Nebrigic et al. | 363/59 |
| 7,436,247 | B2 * | 10/2008 | Saitoh | 327/541 |
| 7,446,514 | B1 | 11/2008 | Li et al. | |
| 8,063,687 | B2 * | 11/2011 | Lee et al. | 327/266 |
| 2005/0052220 | A1 * | 3/2005 | Burgener et al. | 327/536 |
| 2005/0195020 | A1 * | 9/2005 | Matsushita | 327/541 |
| 2008/0001588 | A1 * | 1/2008 | Ikeda | 323/282 |
| 2009/0128104 | A1 * | 5/2009 | Mandal | 323/273 |

FOREIGN PATENT DOCUMENTS

| | | |
|---|---|---|
| TW | 200534070 | 2/2005 |
| TW | 200917633 A | 4/2009 |
| TW | 200923610 A | 6/2009 |

OTHER PUBLICATIONS

Merriam Webster Dictionary, http://www.merriam-webster.com/dictionary/between.*

Man et al, Development of Single Transistor Control LDO Based on Flipped Voltage Follower for SoC, IEEE Trans. on Circuits and Systems I: Regular Papers, vol. 55, No. 5, pp. 61392-61401, Jun. 2008.

Leung et al, A Capacitor Free CMOS Low Dropout Regulator with Damping Factor Control Frequency Compensation, IEEE J. of Solid-State Circuits, vol. 38, No. 10, pp. 1691-1702, Oct. 2003.

(Continued)

*Primary Examiner* — Adolf Berhane
*Assistant Examiner* — Gustavo Rosario Benitez
(74) *Attorney, Agent, or Firm* — WPAT, P.C.; Anthony King

(57) ABSTRACT

The present invention relates to a low dropout regulator, and more particularly to a low dropout regulator without load capacitor and ESR (equivalent series resistance) designed in response to the discharge curve of a Li-ion battery, includes an input terminal, a reference circuit, a power transfer element, a level regulating device, a regulating circuit, and a first N-type MOSFET. The regulating circuit detects a load change at an output terminal, amplifies the load change, and couples it to the level regulating device. The level regulating device receives and boosts a received signal and transmits the received signal to the power transfer element, so as to achieve the effect of controlling the power of a power supply.

13 Claims, 7 Drawing Sheets

(56) References Cited

OTHER PUBLICATIONS

Hazucha et al, Area Efficient Linear Regulator with Ultra Fast Load Regulation, IEEE J. of Solid-State Circuits, vol. 40, No. 4, pp. 933-940, Apr. 2005.

Office Action of corresponding TW patent application No. 098131132 issued Jan. 30, 2013 cites US 7446514B1, TW 200917633A, TW 200923610A.
English Abstracts of TW 200917633A and TW 200923610A.

* cited by examiner

LOW DROPOUT REGULATOR

FIELD OF THE INVENTION

The present invention relates to a low dropout regulator (LDO), and more particularly to a low dropout regulator without load capacitor and ESR (equivalent series resistance) designed in response to the discharge curve of a Li-ion battery.

BACKGROUND OF THE INVENTION

When a Li-ion battery is used as a power supply, the voltage of the battery end will drop from 4.2V to 3.3V during the discharging process. Therefore, a voltage regulator is needed to regulate the battery voltage to a stable voltage for supplying to an electronic product. Hence, a low dropout regulator is most suitable for this purpose under the premise of reducing volume.

However, conventional low dropout regulators, such as that disclosed in Taiwan Patent No. 200534070, often require external load capacitors to stabilize and boost transient response. Therefore, it has become a critical issue of developing a low dropout regulator that does not require external passive elements or requires only very few number of passive elements. For example, the following articles all discuss similar low dropout regulators:

[1] IEEE Trans. on Circuits and Systems I: Regular Papers, Vol. 55, No. 5, pp. 61392-1401, June 2008;

[2] IEEE J. of Solid-State Circuits, Vol. 38, No. 10, pp. 1691-1702, October 2003; and

[3] IEEE J. of Solid-State Circuits, Vol. 40, No. 4, pp. 933-940, April 2005.

However, all of the low dropout regulators proposed in the above articles may not be applied to a power supply with a relatively large input range.

It is therefore tried by the inventors to develop a low dropout regulator that is designed to use a Li-ion battery as a power supply input, and to provide a stable voltage source given different load changes without any external load capacitor when working under different voltage inputs.

The present invention may effectively reduce the chip manufacturing cost and be integrated on a chip easily. The present invention is an improved no-load-capacitor low dropout regulator. A preferred embodiment of the low dropout regulator according to the present invention has been implemented in a typical CMOS process.

SUMMARY OF THE INVENTION

In view of the aforementioned problems of the prior art, the primary object of the present invention is to provide a low dropout regulator that receives an input power from a Li-ion battery or a rechargeable battery, and provides a stable voltage output given different loads.

According to the object of the present invention, the low dropout regulator is provided, comprising a reference circuit, a power transfer element, a regulating circuit, and a lever regulating device. The reference circuit provides a comparing voltage and bias voltage sources to the regulating circuit and the level regulating device. The power transfer element provides different output power during switching between different loads. The regulating circuit detects a voltage change at the output terminal due to a load change, amplifies the voltage change, and transmits the amplified voltage change to the level regulating device; the regulating circuit also utilizes common gate amplification to add a compensating capacitor to achieve phase compensation so as to maintain the stability of the circuit. The level regulating device boosts the received signal based on the amplified voltage change and transmits the boosted signal to the power transfer element.

The reference circuit comprises a biasing circuit, a voltage level circuit, and a transconductance amplifier. The biasing circuit provides other circuits with a working voltage that is not subject to temperature or system voltage variations. The voltage level circuit provides a voltage level for comparison. The transconductance amplifier receives and feeds back a voltage signal from the voltage level circuit.

With the above arrangements, the low dropout regulator of the present invention attains the following advantages:

(1) The low dropout regulator may be applicable to an input power from a Li-ion battery, and provides stable output power given different load changes without any external load capacitor.

(2) The low dropout regulator is a circuit system not subject to variations in temperature and load voltage.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
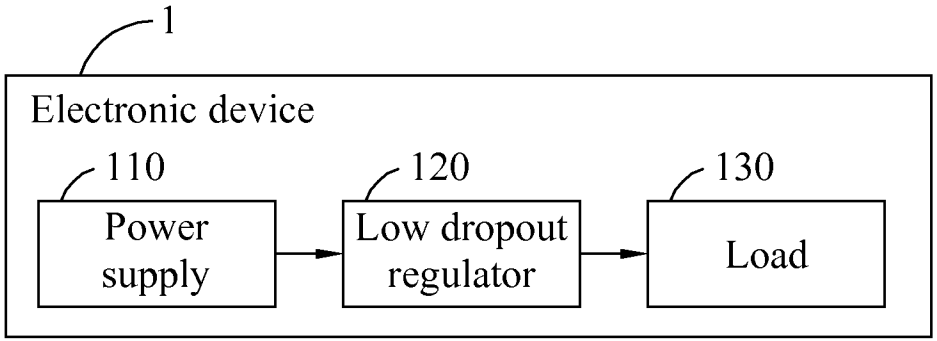
FIG. 1 is a block diagram of an electronic device with a low dropout regulator according to the present invention.

Referring to FIG. 1, a block diagram of an electronic device 1 with a low dropout regulator according to the present invention is illustrated. As shown in the figure, the electronic device 1 includes a power supply 110, a low dropout regulator 120, and a load 130. Preferably, the power supply 110 is a Li-ion battery or a rechargeable battery providing a voltage source between 4.2~3.3V. An unstable input power form the power supply 110 is converted into a stable output power by the low dropout regulator 120 in responsive to changes at the load 130. The load 130 may be any circuit that requires a stable voltage source.

Figure 2:
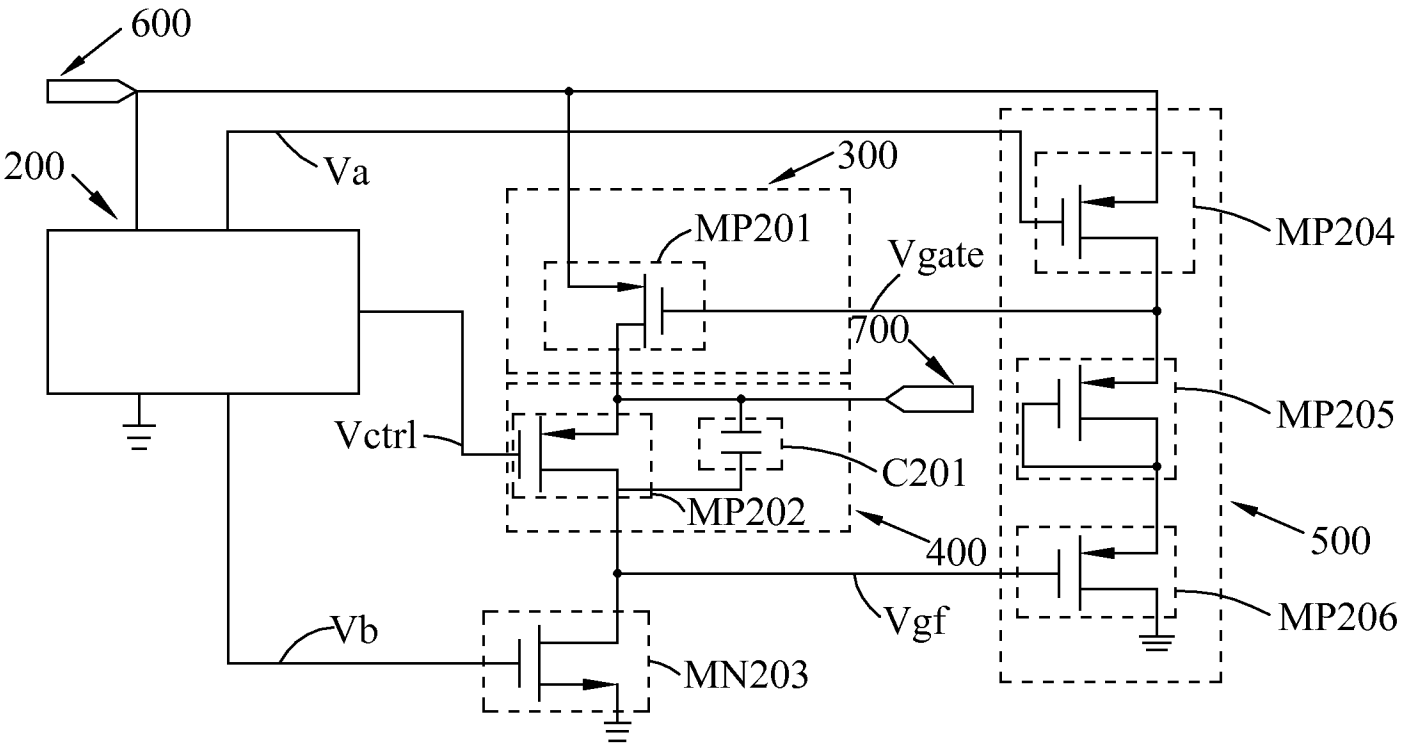
FIG. 2 is a circuit diagram of a low dropout regulator according to a preferred embodiment of the present invention.

Please refer to FIG. 2. A circuit diagram of a low dropout regulator according to a preferred embodiment of the present invention is illustrated. As shown in the figure, the low dropout regulator comprises a reference circuit 200, a power transfer element 300, a regulating circuit 400, a level regulating device 500, a first N-type metal-oxide-semiconductor field effect transistor (MOSFET) MN203, an input terminal 600, and an output terminal 700. Two bias voltages, Va and Vb, generated by the reference circuit 200 are sent to the level regulating device 500 and the transistor MN203, respectively. A comparing bias voltage $V_{ctrl}$ also generated by the reference circuit 200 is output to the regulating circuit 400. Preferably, the power transfer element 300 is a first P-type MOSFET MP201 to achieve the effect of controlling the power of the output power to the output terminal 700. Furthermore, due to the Miller effect, two poles are generated at the gate with a voltage $V_{gate}$ and the drain of the first P-type MOSFET MP201. The source, the gate, and the drain of the first P-type MOSFET MP201 are coupled to the input terminal 600, the level regulating device 500, and the regulating circuit 400, respectively.

Through an effect of common-gate amplification of a second P-type MOSFET MP202, the regulating circuit 400 amplifies a signal change of the output terminal 700 at the source of the second P-type MOSFET MP202 and couples the amplified signal change to the drain with a voltage $V_{gf}$. A compensating capacitor C201 is connected between the source and the drain of the second P-type MOSFET MP202 in the regulating circuit 400 to produce a dominant pole and a zero. Furthermore, the gate of the second P-type MOSFET MP202 is coupled to the reference circuit 200 to receive the comparing bias voltage $V_{ctrl}$; the source of the second P-type MOSFET MP202 is coupled to the output terminal 700 and the power transfer element 300; and the drain of the second P-type MOSFET MP202 is coupled to the level regulating device 500 and the drain of the first N-type MOSFET MN203 to transmit the drain voltage $V_{gf}$ to the level regulating device 500.

The drain voltage $V_{gf}$ is received and boosted by the level regulating device 500 for transmitting the boosted drain voltage $V_{gf}$ to the power transfer element 300. The level regulating device 500 comprises a third P-type MOSFET MP204, a fourth P-type MOSFET MP205, and a fifth P-type MOSFET MP206. The source, gate and drain of the third P-type MOSFET MP204 are coupled to the input terminal 600, the bias voltage Va, and a source of the fourth MOSFET MP205, respectively. The gate of the fourth P-type MOSFET MP205 is coupled to the drain of the fourth P-type MOSFET MP205 and the source of the fifth P-type MOSFET MP206. The gate and the drain of the fifth P-type MOSFET MP206 are coupled to the $V_{gf}$, and the drain being grounded, respectively.

Figure 3:
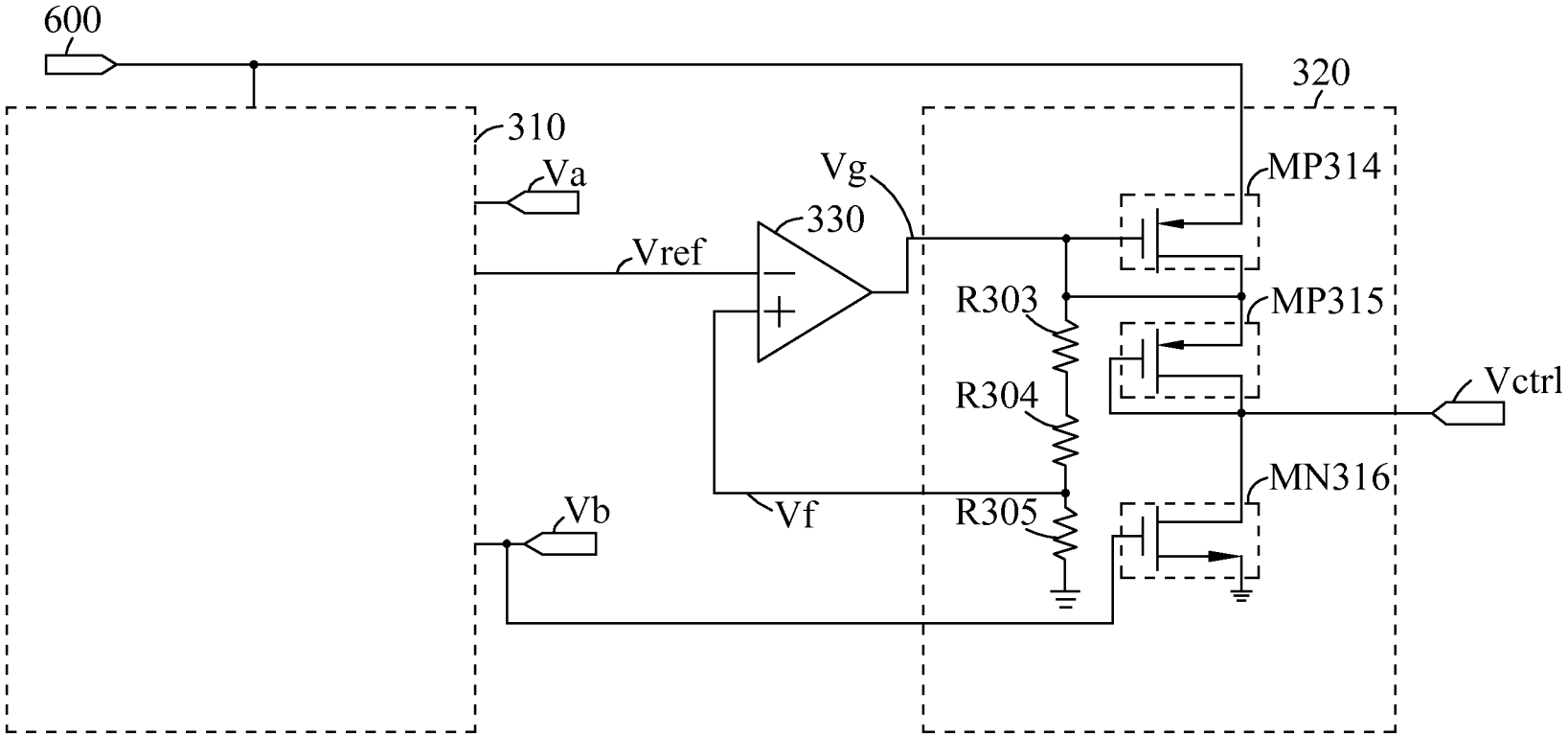
FIG. 3 is a circuit diagram of a reference circuit for the low dropout regulator of the present invention.

Please refer to FIG. 3. A circuit diagram of the reference circuit of the low dropout regulator according to the present invention is illustrated. As shown in the figure, the reference circuit 200 comprises a biasing circuit 310, a voltage level circuit 320, and a transconductance amplifier 330. The first bias voltage Va and the second bias voltage Vb generated by the biasing circuit 310 are output to other circuits. A comparing voltage $V_{ref}$ also generated by the biasing circuit 310 is output to the transconductance amplifier 330. The voltage level circuit 320 uses a first resistor R303, a second resistor R304, and a third resistor R305 to divide the voltage and outputs a voltage $V_f$ to the transconductance amplifier 330, and receives an output voltage $V_g$ of the transconductance amplifier 330, so as to output the comparing voltage $V_{ctrl}$ to the regulating circuit 400. The voltage level circuit 320 further comprises a first level P-type MOSFET MP314, a second level P-type MOSFET MP315, and a first level N-type MOSFET MN316. The second lever P-type MOSFET MP315 with a common gate formation is serially connected between the first level P-type MOSFET MP314 and the first level N-type MOSFET MN316. The comparing bias voltage $V_{ctrl}$ is output from the gate of the second lever P-type MOSFET MP315 to the regulating circuit 400. The transconductance amplifier 330 may be any amplifier with an amplification function to amplify the comparing voltage $V_{ref}$ and the voltage $V_f$ to output the voltage $V_g$.

Figure 4A:
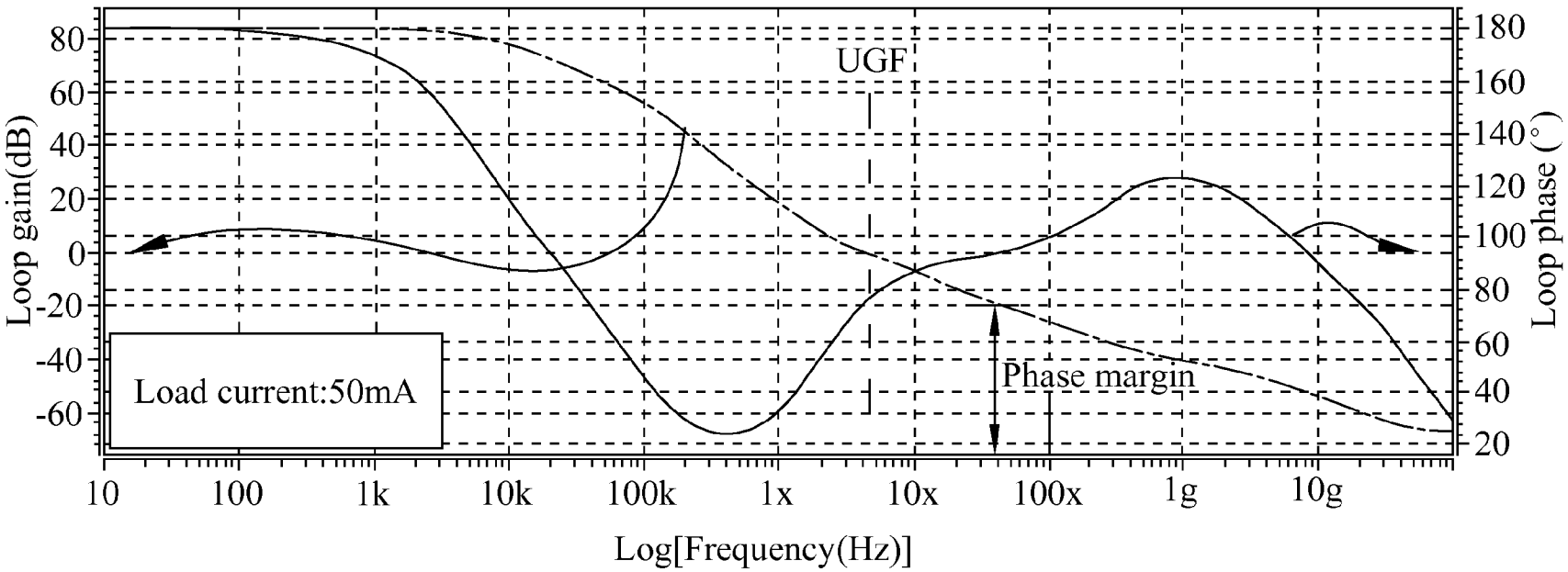
FIG. 4A shows an analog waveform obtained in an AC analysis of the low dropout regulator of the present invention when the load is 50 mA.
Figure 4B:
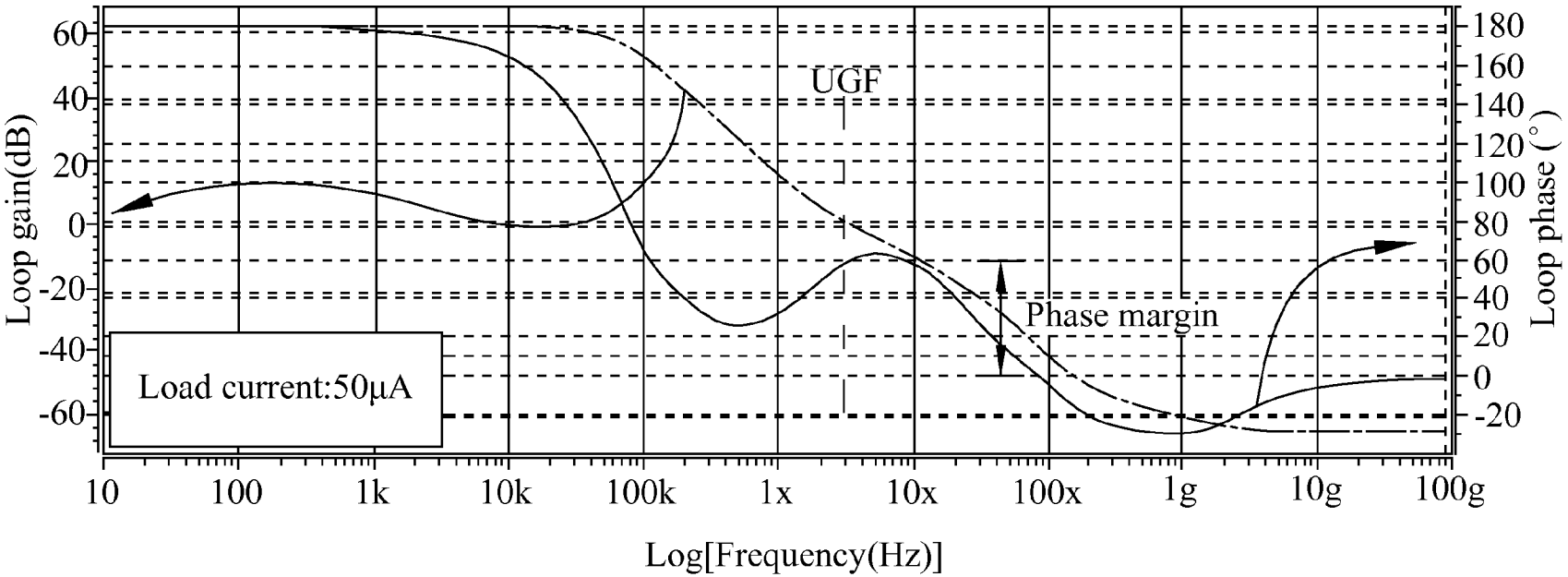
FIG. 4B shows an analog waveform obtained in an AC analysis of the low dropout regulator of the present invention when the load is 50 μA.

FIGS. 4A and 4B show analog waveforms obtained in AC (alternating current) analysis of the low dropout regulator of the present invention when the load currents are 50 mA and 50 μA with a 4.2 V voltage source, respectively. When the load current is 50 mA, the loop gain and the phase margin of the low dropout regulator of the present invention are 83.5 dB and 74.3° respectively, as shown in FIG. 4A. When the load current is 50 μA, the loop gain and the phase margin are 62.9 dB and 61.7°, as shown in FIG. 4B. This indicates that the phase is always within 180° to ensure that the system circuit will operate stably without oscillating during switching between a light or a heavy load according to the FIGS. 4A and 4B.

Figure 5A:
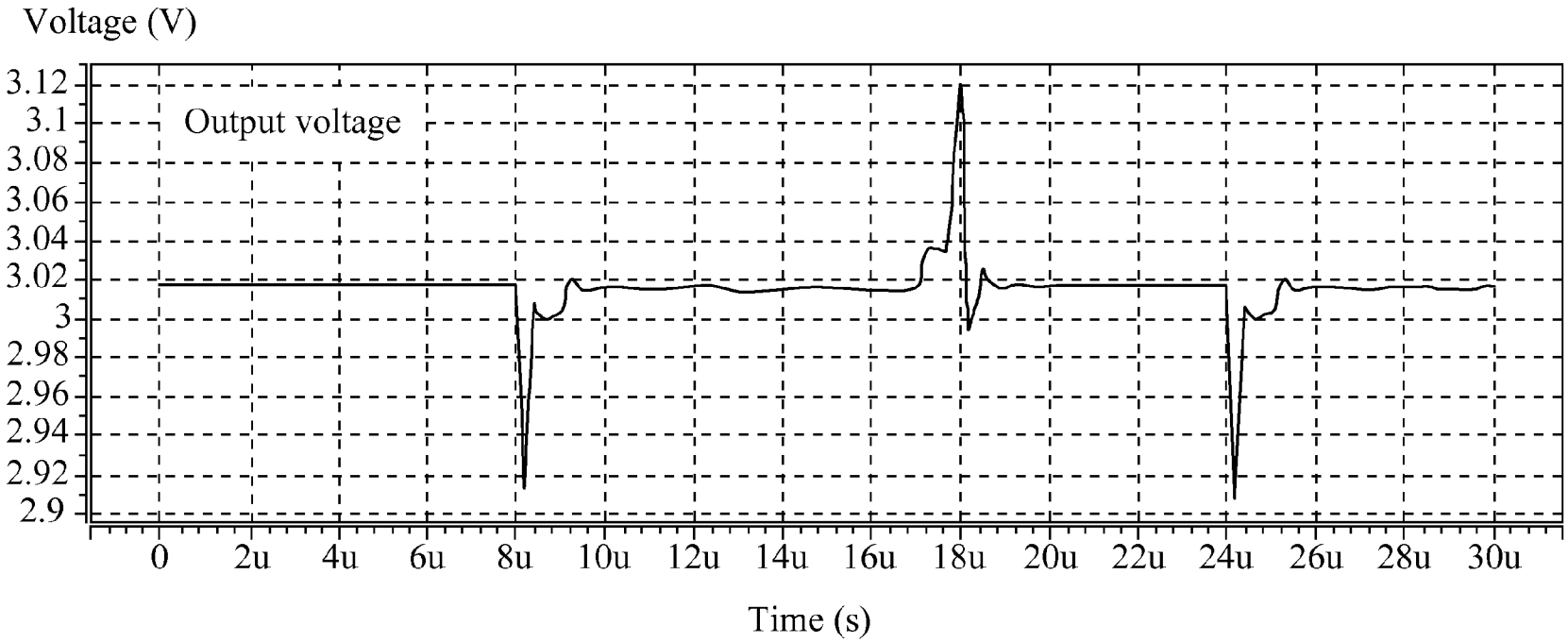
FIG. 5A shows an analog waveform obtained in a voltage transient analysis of the low dropout regulator of the present invention.
Figure 5B:
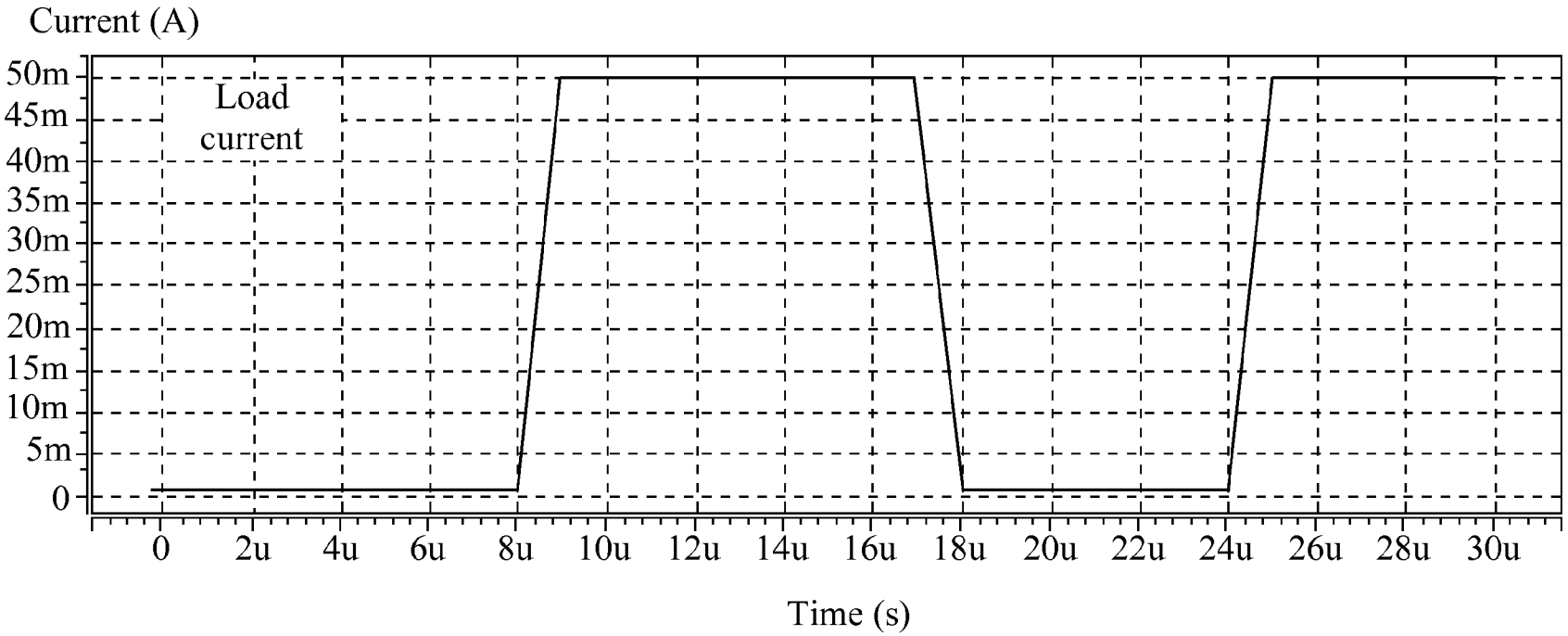
FIG. 5B shows an analog waveform obtained in a current transient analysis of the low dropout regulator of the present invention.

FIGS. 5A and 5B show analog waveforms obtained in voltage transient analysis and current transient analysis, respectively, of the low dropout regulator of the present invention. That is, the analog waveforms shown in FIGS. 5A and 5B are waveform at $V_{out}$ output and waveform at corresponding load current switching, respectively, when the voltage source is 4.2 V. In FIG. 5B, the load current is switched periodically from 50 μA to 50 mA with a 1 μs period. The output voltage $V_{out}$ has a minimum voltage of 2.9154 V and a maximum voltage of 3.1197 V with an average voltage of 3.0163 V.

To show the excellence of the present invention, the illustrated preferred embodiment of the low dropout regulator according to the present invention is implemented in a 0.18 μm 1P6M CMOS process. The following Table 1 compares the present invention with several prior arts.

TABLE 1

Comparison of Specifications

| | Load Capacitor (CL) | Input Voltage ($V_{in}$) | Gain | Line Regulation | Load Regulation |
|---|---|---|---|---|---|
| [3] | 0.6 nF | 1.2 V | N/A | N/A | N/A |
| [1] | None | 1.2~1.5 V | 58 | 18 mV/V | 280 nV/mA |
| Present invention | None | 3.3~4.5 V | 62.9 | 0.145 mV/V | 280 nV/mA |

As can be seen from Table 1, with the present invention, it is not necessary to have any external load capacitor (CL), and the input voltage ($V_{in}$) may have an enlarged range. Furthermore, the gain, the line regulation and the load regulation of the present invention are also improved.

The present invention may be applied to a no-load-capacitor linear voltage regulator connected to a Li-ion battery as a power supply. The present invention has been described with some preferred embodiments thereof and it is understood that many changes and modifications in the described embodiments can be carried out without departing from the scope and the spirit of the invention that is intended to be limited only by the appended claims.

What is claimed is:

1. A low dropout regulator, comprising:

an input terminal for providing a variable input power;

a reference circuit being electrically connected to the input terminal for receiving the input power;

a power transfer element being electrically connected to the input terminal and an output terminal, wherein the power transfer element is receiving the input power from the input terminal and the power transfer element is controlling the power of an output power to the output terminal;

a level regulating device being electrically connected to the output terminal and the reference circuit for receiving the input power and a first bias voltage provided by the reference circuit;

a regulating circuit being electrically connected to the reference circuit, the output terminal, and the level regulating device for receiving a comparing bias voltage provided by the reference circuit and detecting a load change at the output terminal, and amplifying the load change to a first voltage for coupling to the level regulating device, and the regulating circuit further comprises:

a second P-type MOSFET;

a compensating capacitor, connected between a source of the second P-type MOSFET and a drain of the second P-type MOSFET; and a first N-type MOSFET comprising a first gate, a first drain and a first source, the first gate being connected to the reference circuit for receiving a second bias voltage, the first source being grounded, the first drain being connected to the level regulating device and the regulating circuit;

wherein the level regulating device receives the first voltage and boosts the first voltage to a first voltage level, and transmits the first voltage level to the power transfer element, so that the power transfer element controls the power of the output power.

2. The low dropout regulator as claimed in claim 1, wherein the reference circuit comprises a biasing circuit, a voltage level circuit, and a transconductance amplifier connected between the biasing circuit and the voltage level circuit.

3. The low dropout regulator as claimed in claim 2, wherein the transconductance amplifier comprises a positive input, a negative input and an output, the biasing circuit is electrically connected to the input terminal, the voltage level circuit, and the negative input, and the voltage level circuit is electrically connected to the input terminal, the output, and the positive input.

4. The low dropout regulator as claimed in claim 2, wherein the biasing circuit generates the first bias voltage and the second bias voltage.

5. The low dropout regulator as claimed in claim 2, wherein the transconductance amplifier outputs a signal to the voltage level circuit, and the voltage level circuit feeds back the signal to the transconductance amplifier and generates the comparing bias voltage to the regulating circuit.

6. The low dropout regulator as claimed in claim 1, wherein the power transfer element is a first P-type MOSFET; a source of the first P-type MOSFET being coupled to the input terminal, a gate of the first P-type MOSFET being coupled to the first voltage level, a drain of the P-type MOSFET being coupled to the regulating circuit.

7. The low dropout regulator as claimed in claim 1, wherein a gate of the second P-type MOSFET is coupled to the reference circuit for receiving the comparing bias voltage, the source of the second P-type MOSFET being coupled to the output terminal and the power transfer element, the drain of the second P-type MOSFET being coupled to the level regulating device and the first N-type MOSFET.

8. The low dropout regulator as claimed in claim 1, wherein the level regulating device comprises a third P-type MOSFET, a fourth P-type MOSFET, and a fifth P-type MOSFET.

9. The low dropout regulator as claimed in claim 8, wherein a source of the third P-type MOSFET is coupled to the input terminal, a gate of the third P-type MOSFET being coupled to the first bias voltage, a drain of the third P-type MOSFET being coupled to a source of the fourth P-tvae MOSFET.

10. The low dropout regulator as claimed in claim 8, wherein a source of the fourth P-type MOSFET is coupled to a drain of the third P-type MOSFET, a gate of the fourth P-type MOSFET being coupled to a drain of the fourth P-type MOSFET and a source of the fifth P-type MOSFET.

11. The low dropout regulator as claimed in claim 8, wherein a source of the fifth P-type MOSFET is coupled to a drain of the fourth P-type MOSFET, a gate of the fifth P-type MOSFET being coupled to the first voltage level, a drain of the fifth P-type MOSFET being grounded.

12. A low dropout regulator, comprising:

an input terminal for providing a variable input power;

a reference circuit being electrically connected to the input terminal for receiving the input power;

a power transfer element being electrically connected to the input terminal and an output terminal, wherein the power transfer element is receiving the input power from the input terminal and the power transfer element is controlling the power of an output power to the output terminal;

a level regulating device being electrically connected to the output terminal and the reference circuit for receiving the input power and a first bias voltage provided by the reference circuit;

a regulating circuit being electrically connected to the reference circuit, the output terminal, and the level regulating device for receiving a comparing bias voltage provided by the reference circuit and detecting a load change at the output terminal, and amplifying the load change to a first voltage for coupling to the level regulating device, wherein the output terminal is coupled between the regulating circuit and the power transfer element, and the regulating circuit further comprises:

a second P-type MOSFET;

a compensating capacitor, connected between a source of the second P-type MOSFET and a drain of the second P-type MOSFET; and a first N-type MOSFET comprising a first gate, a first drain and a first source, the first gate being connected to the reference circuit for receiving a second bias voltage, the first source being grounded, the first drain being connected to the level regulating device and the regulating circuit;

wherein the level regulating device receives the first voltage and boosts the first voltage to a first voltage level, and transmits the first voltage level to the power transfer element, so that the power transfer element controls the power of the output power.

13. A low dropout regulator, comprising:

an input terminal for providing a variable input power;

a reference circuit being electrically connected to the input terminal for receiving the input power;

a power transfer element being electrically connected to the input terminal and an output terminal, wherein the power transfer element is receiving the input power from the input terminal and the power transfer element is controlling the power of an output power to the output terminal;

a level regulating device being electrically connected to the output terminal and the reference circuit for receiving the input power and a first bias voltage provided by the reference circuit;

a regulating circuit being electrically connected to the reference circuit, the output terminal, and the level regulating device for receiving a comparing bias voltage provided by the reference circuit and detecting a load change at the output terminal, and amplifying the load change to a first voltage for coupling to the level regulating device, and the regulating circuit further comprises:

a second P-type MOSFET;

a compensating capacitor, connected between a source of the second P-type MOSFET and a drain of the second P-type MOSFET; and a first N-type MOSFET comprising a first gate, a first drain and a first source, the first gate being connected to the reference circuit for receiving a second bias voltage, the first source being grounded, the first drain being connected to the level regulating device and the regulating circuit;

wherein the level regulating device receives the first voltage and boosts the first voltage to a first voltage level, and transmits the first voltage level to the power transfer element, so that the power transfer element controls the power of the output power, wherein the first drain is arranged to receive the first voltage level boosted by the level regulating device.

* * * * *